US010619966B2

(12) United States Patent
Ozanne et al.

(10) Patent No.: US 10,619,966 B2
(45) Date of Patent: Apr. 14, 2020

(54) ARCHERY BOW WITH BALLAST STABILIZER

(71) Applicant: MCP IP, LLC, Sparta, WI (US)

(72) Inventors: Jeffrey A. Ozanne, La Crosse, WI (US); Brandon J. Gann, Sparta, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 16/186,430

(22) Filed: Nov. 9, 2018

(65) Prior Publication Data

US 2019/0145729 A1 May 16, 2019

Related U.S. Application Data

(60) Provisional application No. 62/584,666, filed on Nov. 10, 2017.

(51) Int. Cl.

| | |
|---|---|
| ***F41B 5/20*** | (2006.01) |
| ***F41B 5/14*** | (2006.01) |
| ***F41B 5/00*** | (2006.01) |

(52) U.S. Cl.

CPC ..... *F41B 5/1426* (2013.01); *F41B 5/0031* (2013.01); *F41B 5/0052* (2013.01)

(58) Field of Classification Search

CPC ..... F41B 5/10; F41B 5/1426

See application file for complete search history.

(56) References Cited

U.S. PATENT DOCUMENTS

| | | | | |
|---|---|---|---|---|
| 3,196,860 | A * | 7/1965 | Hoyt, Jr. | F41B 5/1426 124/24.1 |
| 3,342,172 | A | 9/1967 | Sanders | |
| 3,412,725 | A | 11/1968 | Hoyt, Jr. | |
| 5,388,563 | A | 2/1995 | Hsu | |
| 5,619,981 | A * | 4/1997 | Breedlove | F41B 5/1426 124/86 |
| 5,630,407 | A * | 5/1997 | Gasser | F41B 5/1426 124/89 |
| 5,803,070 | A * | 9/1998 | Martin | F41B 5/1426 124/88 |
| 5,934,266 | A | 8/1999 | Martin et al. | |
| 5,992,403 | A | 11/1999 | Slates | |
| 6,092,516 | A | 7/2000 | Martin et al. | |
| 6,382,201 | B1 | 5/2002 | McPherson et al. | |
| 6,526,957 | B1 | 3/2003 | Leven | |
| 7,434,773 | B1 * | 10/2008 | Minjares | F41A 23/06 124/86 |
| 8,225,778 | B2 | 7/2012 | Walk et al. | |
| 2011/0120440 | A1 | 5/2011 | Stokes | |

* cited by examiner

*Primary Examiner* — John A Ricci

(57) ABSTRACT

In some embodiments, an archery bow comprises a riser, a limb assembly attached to the riser and a stabilizer. The limb assembly comprises a first limb member and a second limb member. The stabilizer is attached to the riser, and at least a portion of the stabilizer is oriented between the first limb member and the second limb member.

20 Claims, 11 Drawing Sheets

ARCHERY BOW WITH BALLAST STABILIZER

CROSS-REFERENCE TO RELATED APPLICATIONS

This application claims the benefit of U.S. Patent Application No. 62/584,666, filed Nov. 10, 2017, the entire content of which is hereby incorporated herein by reference.

BACKGROUND OF THE INVENTION

This invention relates to archery bows and stabilizers for archery bows. Archery bow stabilizers are generally known. A stabilizer often adds mass and increases a bow's moment of inertia, but does so using a relatively large structure that can make the bow large and unwieldy.

There remains a need for novel archery bow designs that provide for greater stability and ease of use.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an archery bow comprises a riser, a limb assembly attached to the riser and a stabilizer. The limb assembly comprises a first limb member and a second limb member. The stabilizer is attached to the riser, and at least a portion of the stabilizer is oriented between the first limb member and the second limb member.

In some embodiments, the limb assembly comprises a limb cup supported by the riser, and the first limb member and the second limb member are supported by the limb cup. In some embodiments, the first limb member and the second limb member support a rotatable member.

In some embodiments, the bow comprises a shooting axis and a longitudinal axis of the stabilizer is oriented orthogonal to the shooting axis. In some embodiments, the stabilizer comprises a spike.

In some embodiments, the limb assembly comprises a tension side and a compression side. A first end of the stabilizer is oriented on the compression side and a second end of the stabilizer is oriented on the tension side.

In some embodiments, a riser comprises a threaded cavity having a central axis oriented parallel to the bowstring in an undrawn condition of the archery bow.

In some embodiments, an archery bow comprises a riser, a limb cup attached to the riser and a stabilizer attached to the limb cup. In some embodiments, the limb cup supports a limb member. In some embodiments, the limb cup supports the stabilizer.

In some embodiments, the limb cup comprises a threaded cavity and the stabilizer comprises a complimentary threaded stud. In some embodiments, the limb cup comprises a plurality of threaded cavities arranged at angles to one another, wherein each cavity supports a stabilizer.

In some embodiments, the second ends of the stabilizers extend away from the limb cup and are aligned on a reference plane. In some embodiments, the stabilizers comprise a stand for the bow.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
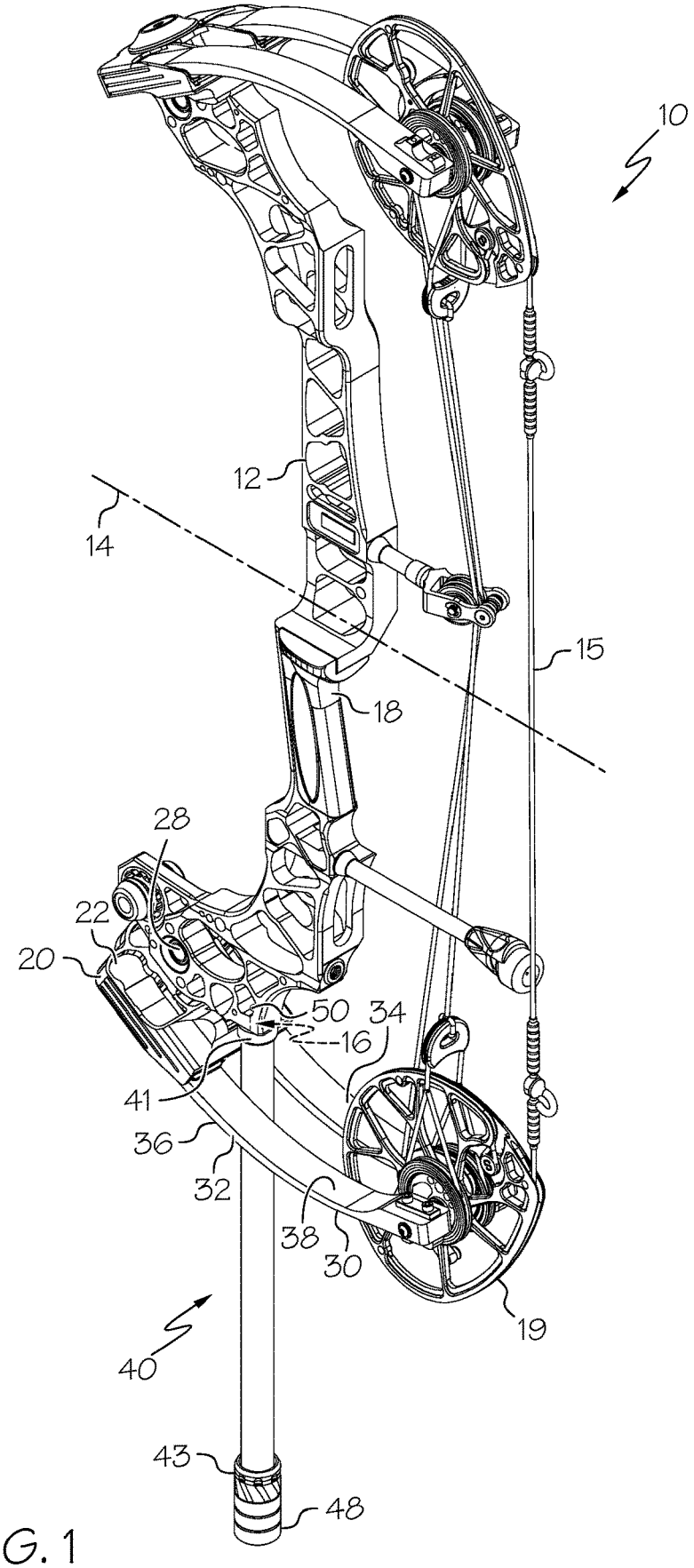
FIGS. 1 and 2 show different views of an embodiment of a bow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of an archery bow 10 that comprises a riser 12 and a stabilizer 40. In some embodiments, a first end 41 of the stabilizer 40 is attached to the riser 12. In some embodiments, the stabilizer 40 extends away from the riser 12 in a downward direction, for example in a direction orthogonal to the shooting axis 14, or in a substantially downward direction. In some embodiments, the stabilizer 40 comprises one or more weights 48, which may be provided a second end 43 of the stabilizer 40 and spaced away from the riser 12 as much as desired.

In some embodiments, the stabilizer 40 concentrates weight 48 as far as possible from the shooting axis 14 and the weight 48 increases a moment of inertia of the bow 10. The stabilizer 40 provides mass that acts as a ballast placed in the lowest location of the bow 10 structure, which lowers the center of gravity and resists torqueing about three orthogonal axes at the grip contact point/area 18. As shown in FIG. 1, the weight 48 provides a high amount of resistance to twisting of the bow 10 about an axis parallel to the shooting axis 14 (e.g. roll) and against rocking in the fore and aft directions (e.g. pitch).

In some embodiments, the stabilizer 40 is attached to the riser 12 using any suitable method. In some embodiments, the riser 12 comprises a threaded cavity 16 arranged to engage the stabilizer 40. In some embodiments, the stabilizer 40 comprises a threaded stud 50 configured to engage the threaded cavity 16. In some embodiments, a central axis of the threaded cavity 16 is oriented orthogonal to the shooting axis 14. In some embodiments, a central axis of the threaded cavity 16 is oriented in a vertical direction. In some embodiments, a central axis of the threaded cavity 16 is oriented parallel to a portion of the bowstring 15 in a brace condition.

Figure 2:
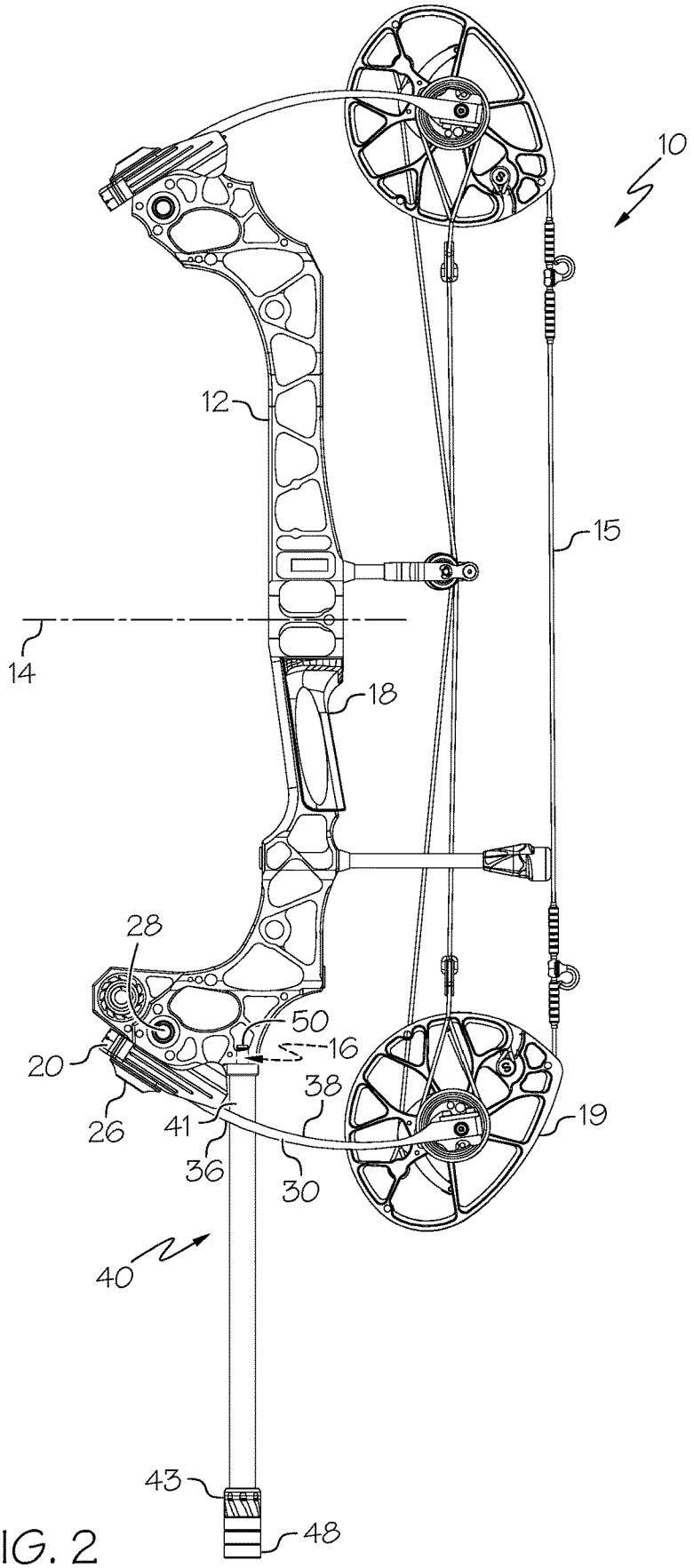

In some embodiments, a limb assembly 30 or limb cup 20 is attached to the riser 12 by a limb bolt 26. In some embodiments, a limb bolt 26 engages bolt threadings that may be provided in the riser 12 or in a limb nut 28. As shown in FIGS. 1 and 2, the limb nut 28 comprises a barrel nut having limb threadings and capable of rotating within the riser 12. In some embodiments, the threaded cavity 16 configured to receive the stabilizer 40 is located farther away from the shooting axis 14 than the limb nut 28 and/or the bolt threadings.

In some embodiments, the limb assembly 30 comprises a first limb member 32 and a second limb member 34. In some embodiments, the limb cup 20 supports the first limb member 32 and the second limb member 34. In some embodiments, the limb cup 20 comprises features as disclosed in U.S. Pat. No. 8,453,635. In some embodiments, the limb cup 20 comprises a first cavity 22 and a second cavity 24. In some embodiments, the first cavity 22 receives the first limb member 32 and the second cavity 24 receives the second limb member 34.

In some embodiments, the stabilizer 40 extends between the first limb member 32 and the second limb member 34. In some embodiments, the first limb member 32 and the second limb member 34 support a rotatable member 19. In some embodiments, the first limb member 32 and the second limb member 34 are separated by a gap 33, and a portion of the stabilizer 40 is oriented in the gap 33.

In some embodiments, a limb member 32, 34 or a limb assembly 30 comprises a tension side 36 and a compression side 38. In some embodiments, the first end 41 of the stabilizer 40 is oriented on the compression side 38, and the second end 43 of the stabilizer is oriented on the tension side 36.

Figure 3:
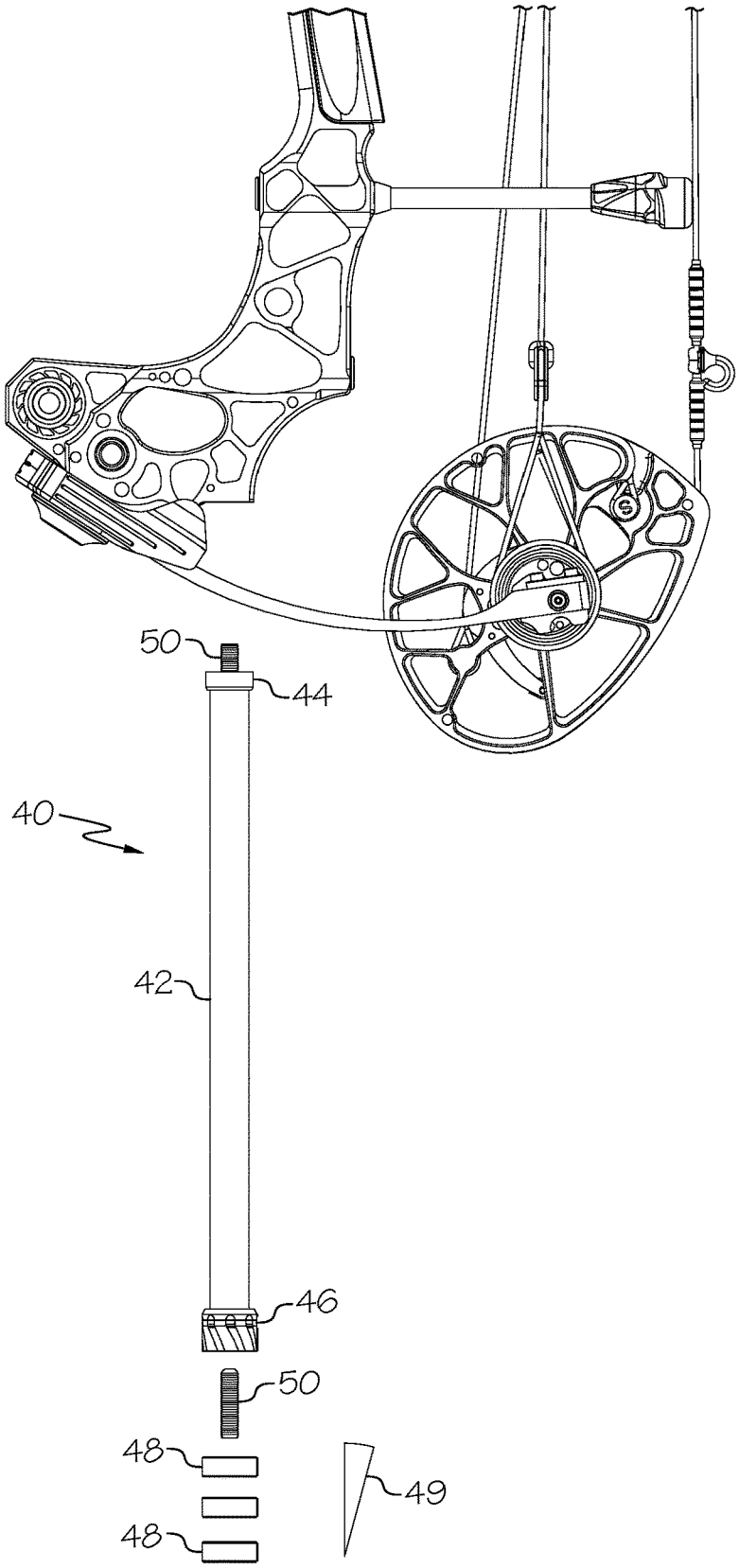
FIGS. 3 and 4 show exploded views of the bow of FIG. 1.
Figure 4:
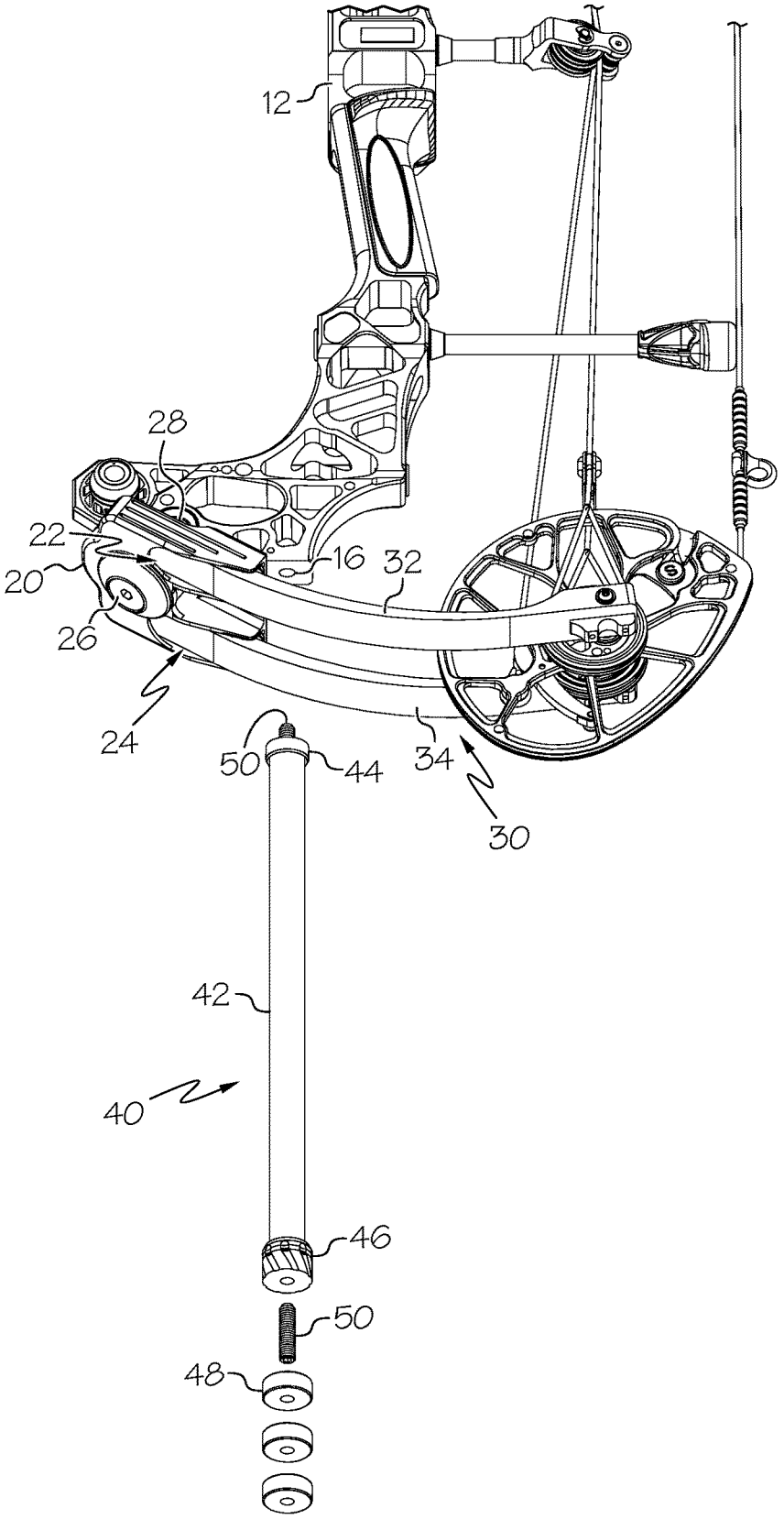
Figure 5:
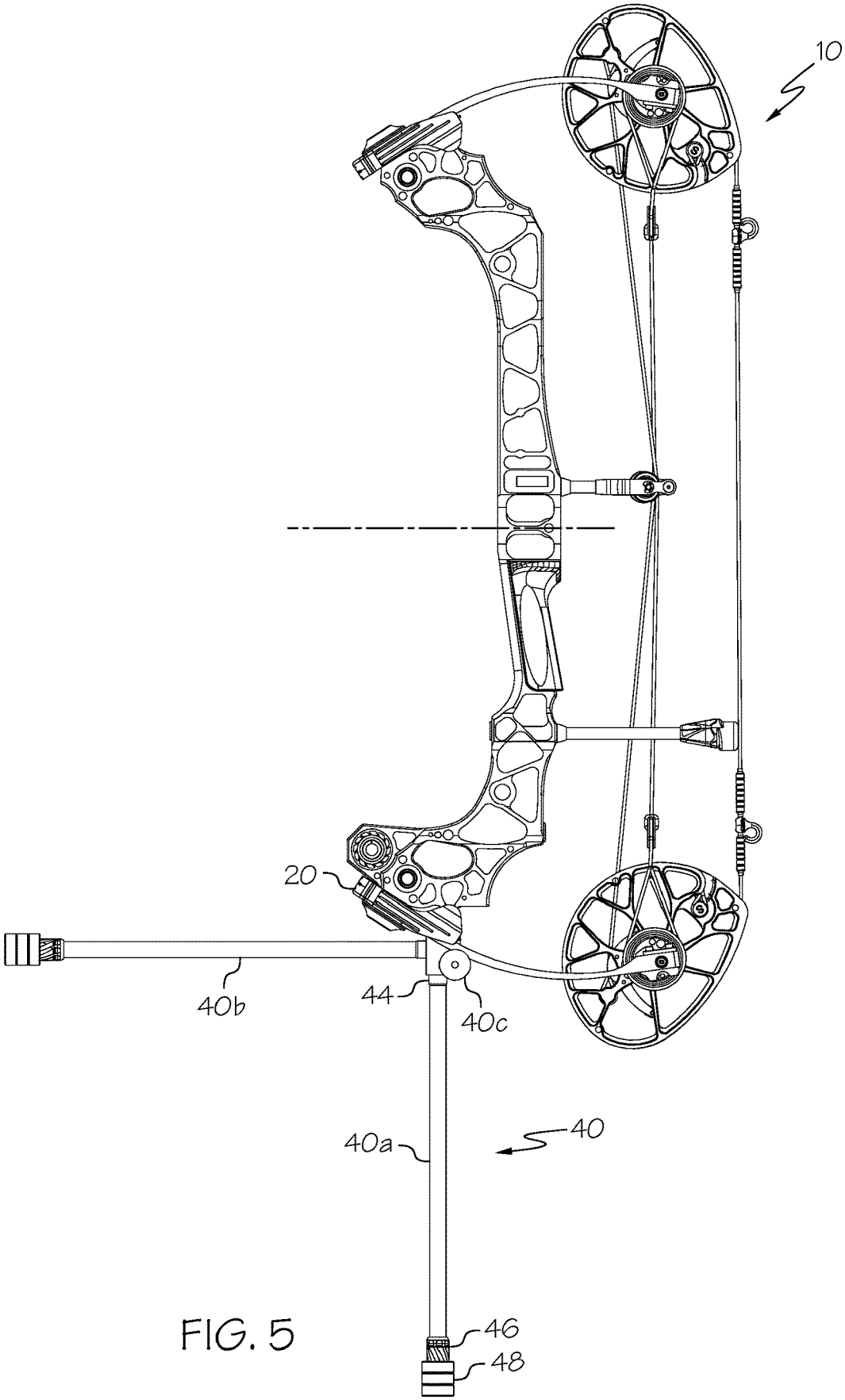
FIGS. 5-7 show different views of another embodiment of a bow.
Figure 6:
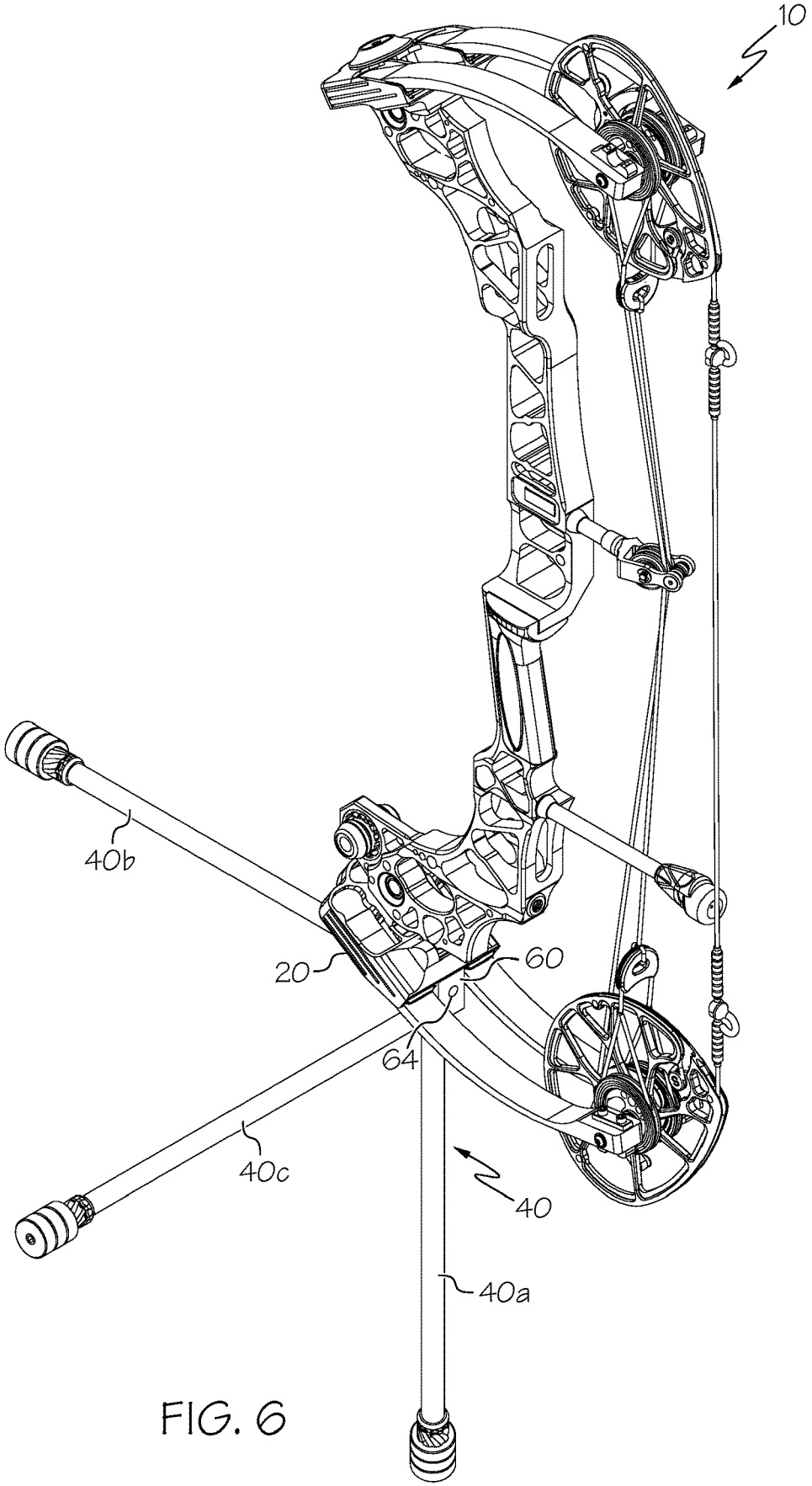
Figure 7:
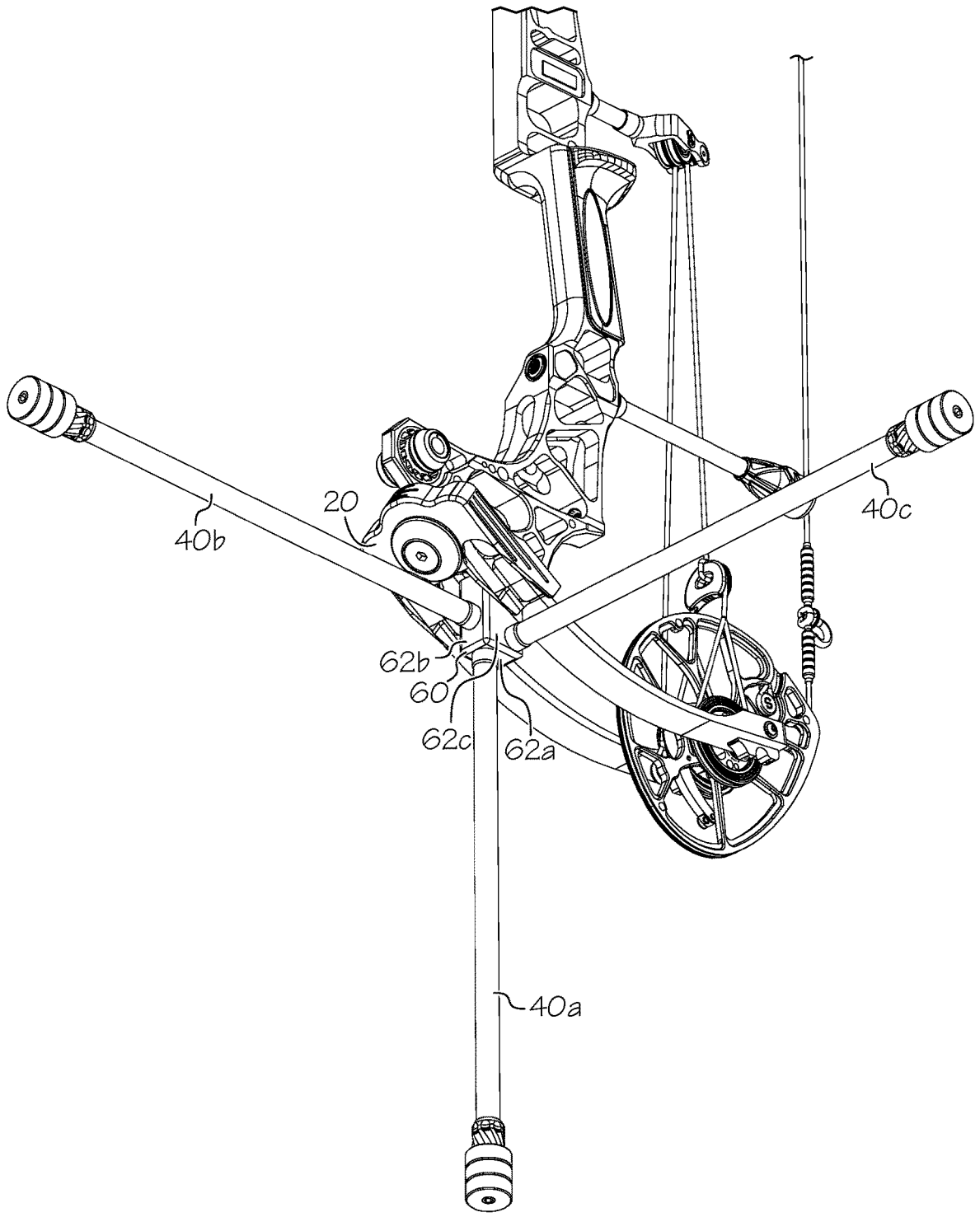
Figure 8:
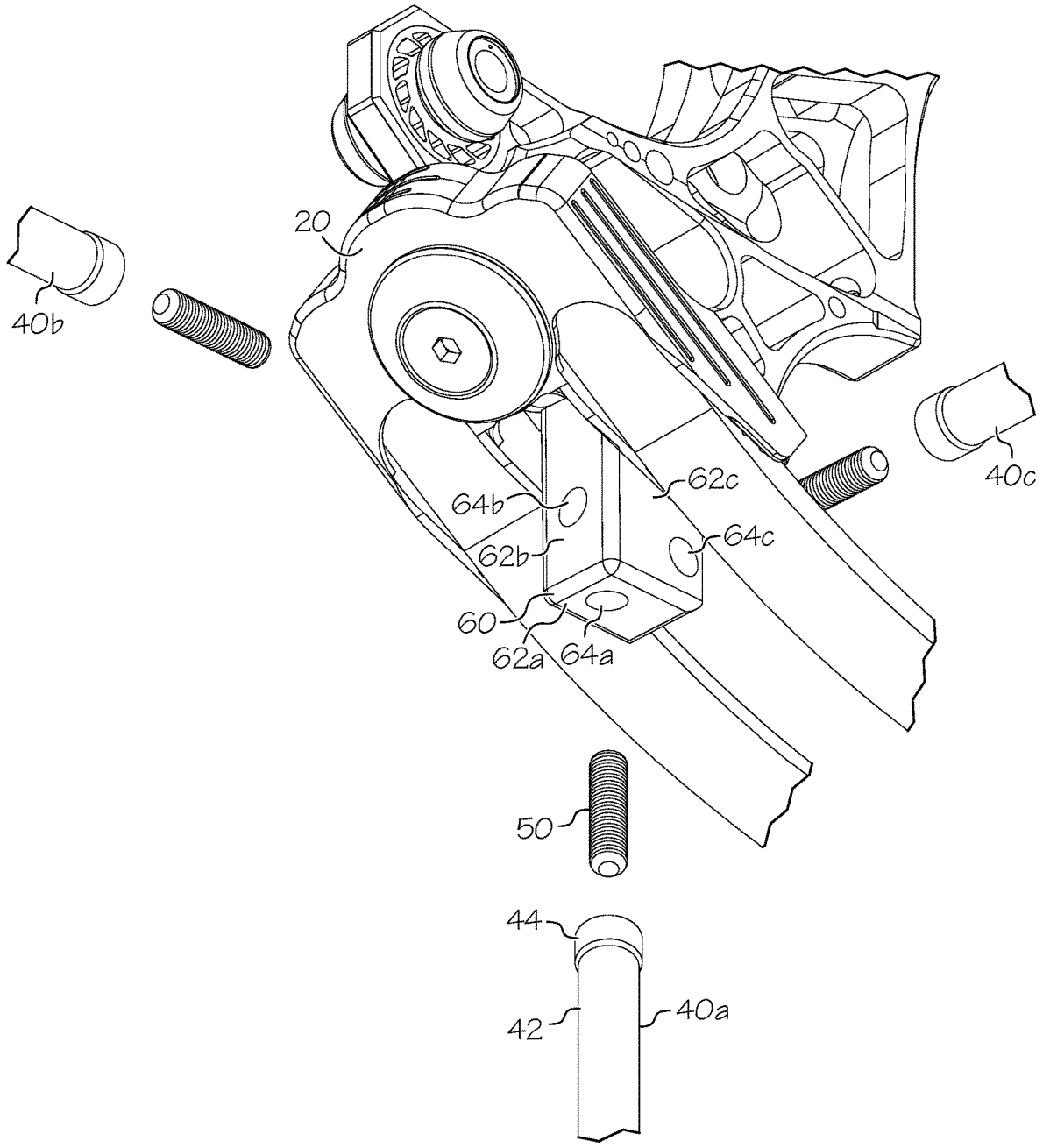
FIG. 8 shows an exploded view of the bow of FIG. 5.

FIGS. 3 and 4 show exploded view of the bow 10 of FIG. 1. In some embodiments, the stabilizer 40 comprises a shaft 42, a first end adapter 44 and a second end adapter 46. In some embodiments, it is desirable for the shaft 42 to be as light as possible and as stiff as possible. In some embodiments, the shaft 42 is made from carbon fiber or another material that may not be desirable for forming threadings to engage a mounting stud 50. In some embodiments, an end adapter 44, 46 is used to terminate the shaft 42 and provide threadings to engage a mounting stud 50. In some embodiments, the second end adapter 46 engages a mounting stud 50 and the mounting stud 50 engages the weights 48. The weights 48 can have any suitable size, shape, mass and configuration. In some embodiments, a weight 48 comprises a spike 49. In some embodiments, a spike 49 can be used to pierce the ground, and the stabilizer 40 can be used as a stand for the bow 10.

FIGS. 5-8 show another embodiment of an archery bow 10 wherein a stabilizer 40 attaches to a limb cup 20. In some embodiments, the bow 10 comprises multiple stabilizers 40*a*, 40*b*, 40*c*, and each stabilizer 40*a*, 40*b*, 40*c* attaches to the limb cup 20.

In some embodiments, a limb cup 20 comprises an outwardly projecting structure that comprises a stabilizer mount 60. In some embodiments, a stabilizer mount 60 is configured for attachment to multiple stabilizers 40*a*, 40*b*, 40*c*. In some embodiments, a limb cup 20 comprises multiple stabilizer mounts 60 (not illustrated).

In some embodiments, a stabilizer mount 60 comprises a cavity 64, for example arranged to receive a threaded stud 50. In some embodiments, a stabilizer mount 60 comprises a flat surface 62 that surrounds the cavity 64, and the flat surface 62 will abut a flat surface of the stabilizer 40.

In various embodiments, a bow 10 can comprise any suitable number of stabilizers 40*a*, 40*b*, 40*c*, and the limb cup 20 can comprise a mounting structure (e.g. cavity 64) for each stabilizer 40.

In some embodiments, cavities 64 are provided to allow stabilizers 40*a*, 40*b*, 40*c* to extend along each of the 3 orthogonal axes (e.g. parallel to the shooting axis 14 and two axes orthogonal to the shooting axis 14).

Figure 9:
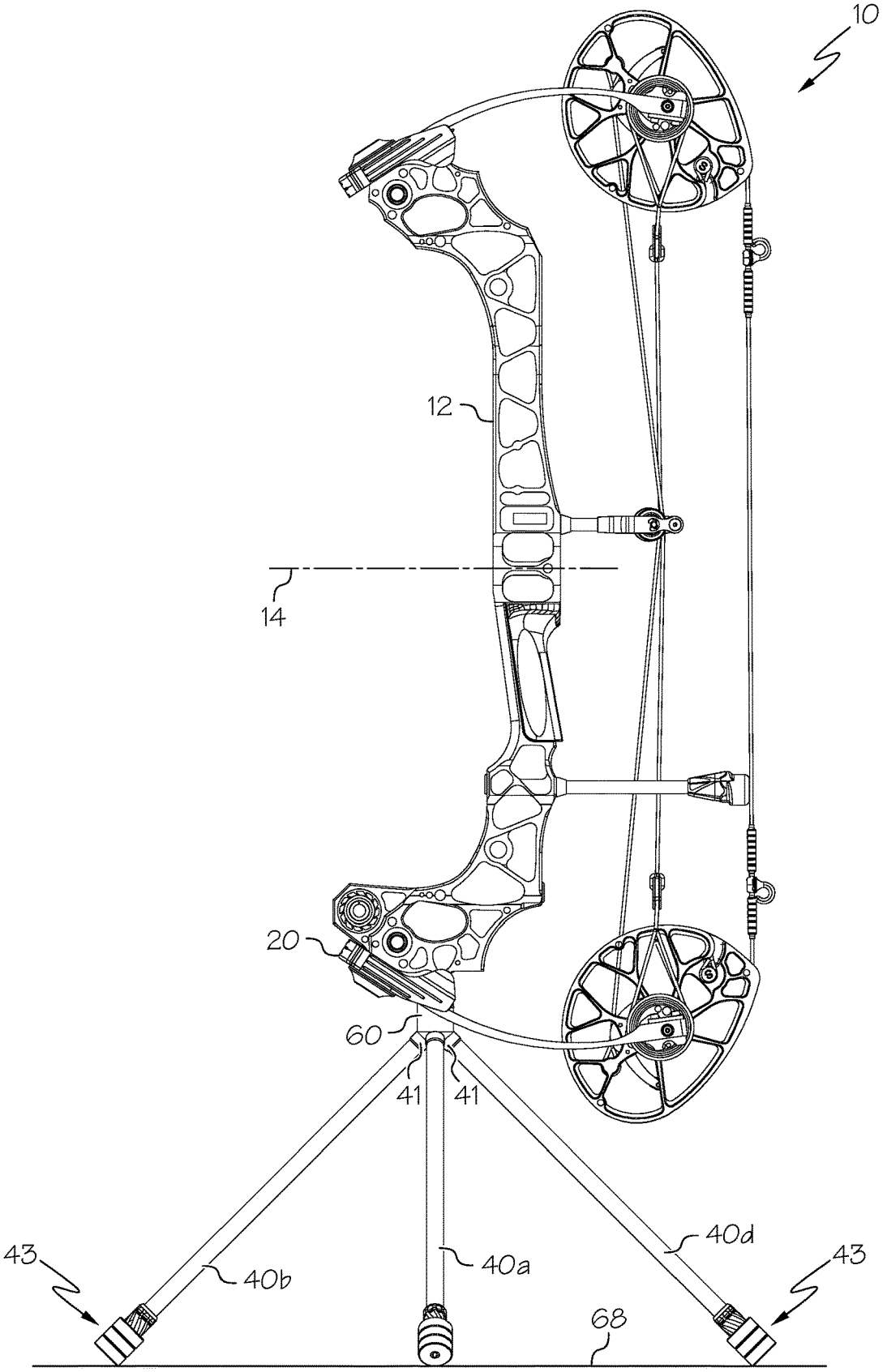
FIGS. 9 and 10 show different views of another embodiment of a bow.
Figure 10:
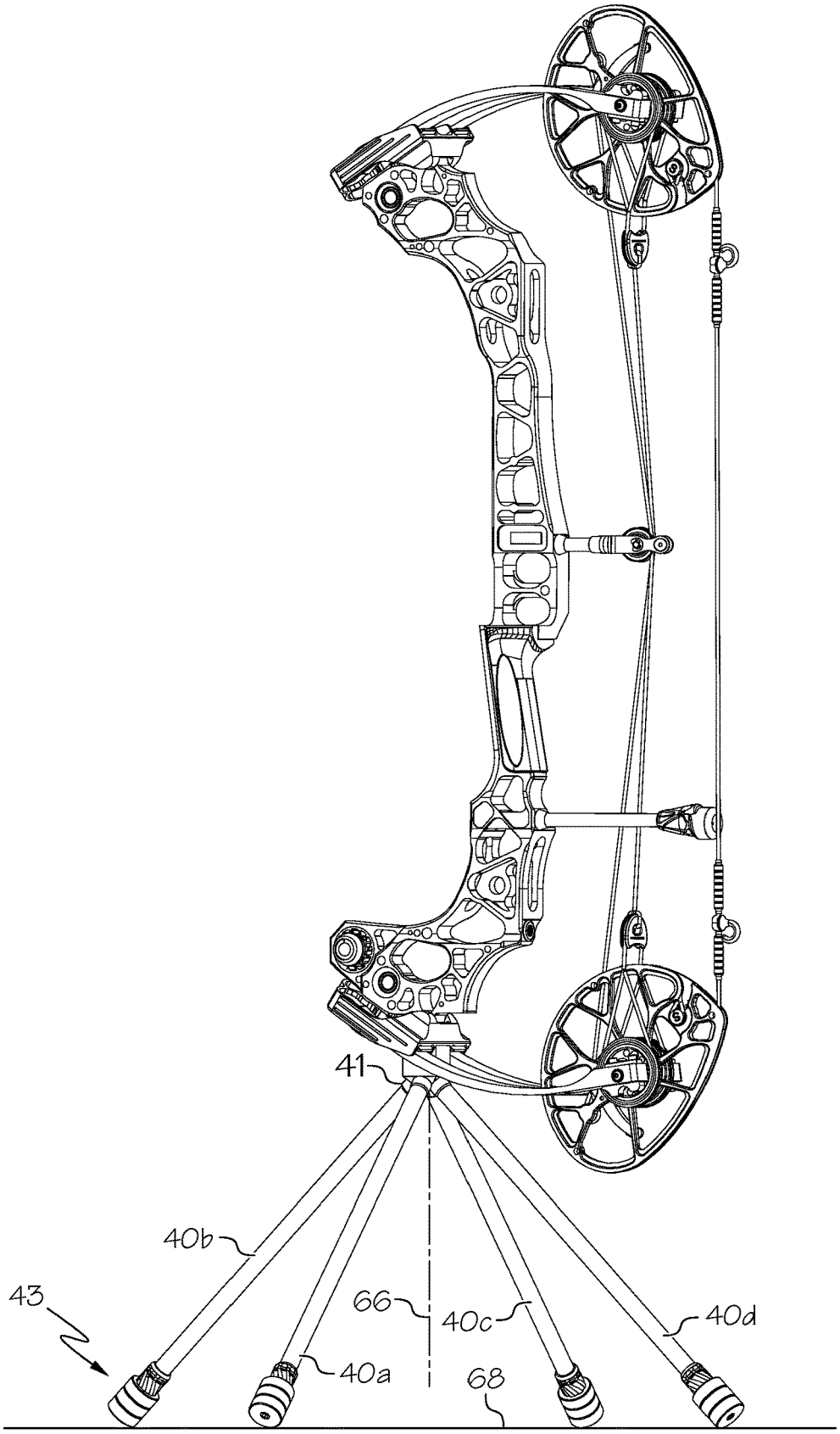
Figure 11:
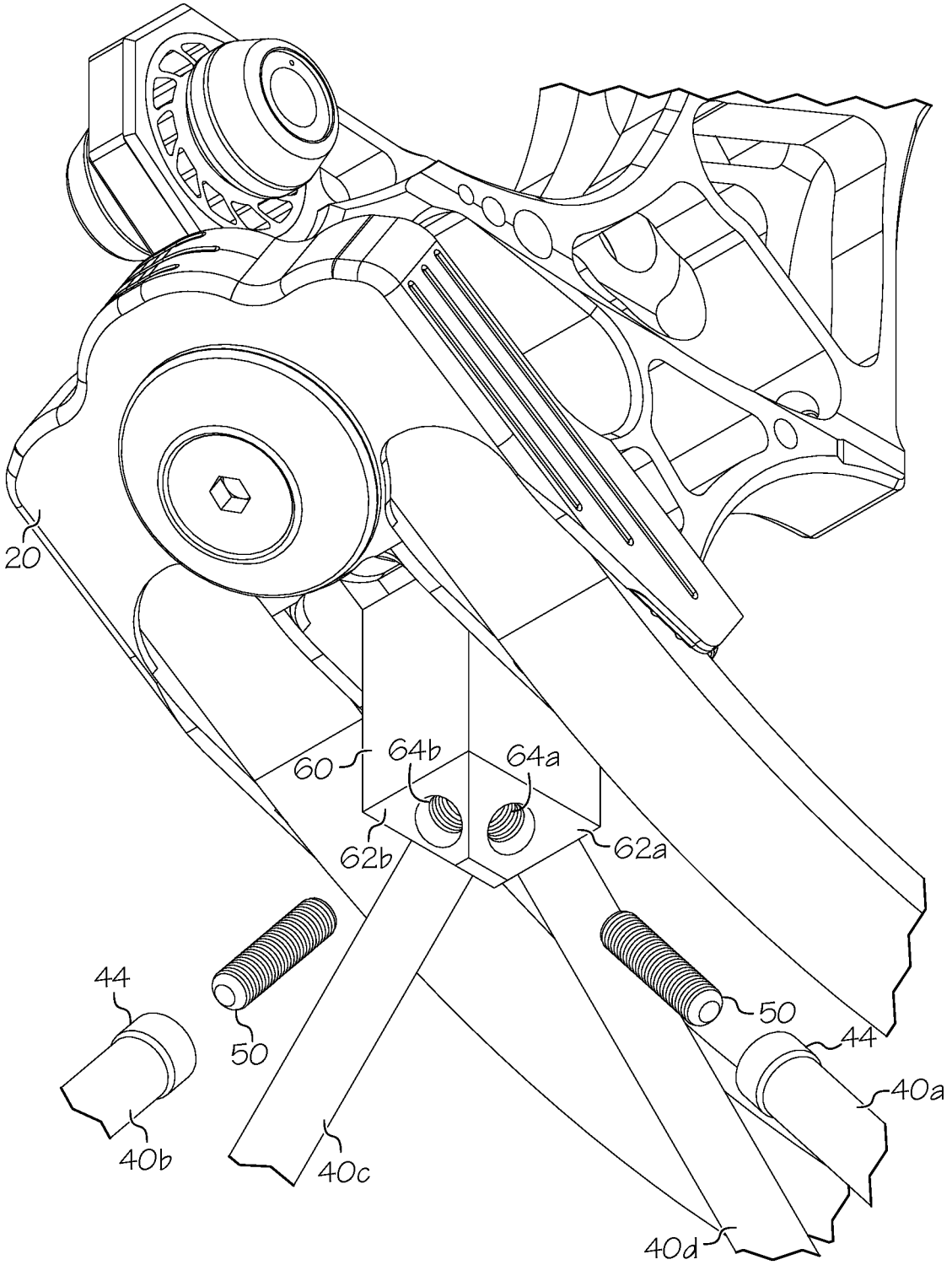
FIG. 11 shows an exploded view of the bow of FIG. 9.

FIGS. 9-11 show another embodiment of an archery bow 10. In some embodiments, multiple stabilizers 40*a*, 40*b*, 40*c*, 40*d* extend at angles to one another and provide a stand structure comprising a bipod, tripod, quadpod, etc. In some embodiments, multiple stabilizers 40 extend at equal but opposite angles to a reference axis 66, such as a vertical axis. In some embodiments, the cavities 64*a*-64*d* and flat surfaces 62*a*-62*d* are arranged to provide such orientations to the stabilizers 40*a*-40*d*.

In some embodiments, the second ends 43 of the stabilizers 40*a*-40*d* are aligned on a reference plane 68. In some embodiments, the reference plane 68 can represent the ground, and the bow 10 is supported by the stabilizers 40*a*-40*d*. In some embodiments, the stabilizers 40*a*-40*d* comprise a stable base that can support the bow 10 with the second ends 43 contacting the supporting surface/reference plane 68. In some embodiments, no object contacts or supports the bow 10 except the stabilizers 40*a*-40*d*. In some embodiments, the reference plane 68 is oriented parallel to the shooting axis 14.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bow comprising:

a riser;

a limb assembly attached to the riser, the limb assembly comprising a first limb member and a second limb member, the first limb member and the second limb member supporting a rotatable member; and a stabilizer attached to the riser, at least a portion of the stabilizer oriented between the first limb member and the second limb member.

2. The archery bow of claim 1, the limb assembly comprising a limb cup, the limb cup supported by the riser, the first limb member supported by the limb cup, the second limb member supported by the limb cup.

3. The archery bow of claim 1, the bow comprising a shooting axis, the stabilizer comprising a weight, wherein a distance between the shooting axis and the weight is greater than a distance between the shooting axis and another portion of the bow.

4. The archery bow of claim 1, the first limb member separated from the second limb member by a gap, a portion of the stabilizer oriented in the gap.

5. The archery bow of claim 1, the bow comprising a shooting axis, a longitudinal axis of the stabilizer oriented orthogonal to the shooting axis.

6. The archery bow of claim 1, the limb assembly comprising a tension side and a compression side, a first end of the stabilizer oriented on the compression side, a second end of the stabilizer oriented on the tension side.

7. The archery bow of claim 6, the second end of the stabilizer comprising a weight.

8. The archery bow of claim 1, a first end of the stabilizer attached to the riser, a second end of the stabilizer comprising a spike.

9. The archery bow of claim 1, comprising a bowstring, the riser comprising a threaded cavity, a central axis of the threaded cavity oriented parallel to the bowstring in an undrawn condition of the archery bow.

10. An archery bow comprising:

a riser;

a limb cup attached to the riser, the limb cup supporting a limb; and a stabilizer attached to the limb cup;

the bow comprising a shooting axis, a longitudinal axis of the stabilizer oriented orthogonal to the shooting axis.

11. The archery bow of claim 10, the limb cup comprising a threaded cavity, the stabilizer comprising a threaded stud.

12. The archery bow of claim 10, the stabilizer comprising a first end attached to the limb cup and a second end extending away from the riser.

13. The archery bow of claim 10, the bow comprising a shooting axis, the stabilizer comprising a weight, wherein a distance between the shooting axis and the weight is greater than a distance between the shooting axis and another portion of the bow.

14. The archery bow of claim 13, the stabilizer comprising a first stabilizer, the archery bow comprising a second stabilizer attached to the limb cup, the second stabilizer oriented at a non-zero angle to the first stabilizer.

15. The archery bow of claim 14, the first stabilizer oriented orthogonally to the second stabilizer.

16. An archery bow comprising:

a riser;

a limb cup attached to the riser, the limb cup supporting a limb; and a first stabilizer attached to the limb cup, the archery bow further comprising a second stabilizer attached to the limb cup, the second stabilizer oriented at a non-zero angle to the first stabilizer.

17. The archery bow of claim 16, comprising a third stabilizer, the third stabilizer oriented at a non-zero angle to the first stabilizer, the third stabilizer oriented at a non-zero angle to the second stabilizer.

18. The archery bow of claim 17, the first stabilizer, the second stabilizer and the third stabilizer each comprising a second end, the second ends aligned on a reference plane.

19. The archery bow of claim 18, the first, second and third stabilizers comprising a stable support for the archery bow.

20. The archery bow of claim 18, the reference plane oriented parallel to a shooting axis of the archery bow.

* * * * *